US009027802B2

(12) United States Patent
Steiner et al.

(10) Patent No.: US 9,027,802 B2
(45) Date of Patent: May 12, 2015

(54) FIREPROOF UNIT FOR A SLIDING CLOSURE AT THE SPOUT OF A CONTAINER FOR METAL MELT

(75) Inventors: Benno Steiner, Nebikon (CH); Werner Keller, Steinhausen (CH)

(73) Assignee: Stopinc Aktiengesellschaft, Hunenberg (CH)

( * ) Notice: Subject to any disclaimer, the term of this patent is extended or adjusted under 35 U.S.C. 154(b) by 405 days.

(21) Appl. No.: 13/502,275

(22) PCT Filed: Oct. 13, 2010

(86) PCT No.: PCT/EP2010/006246

§ 371 (c)(1),
(2), (4) Date: May 15, 2012

(87) PCT Pub. No.: WO2011/047799

PCT Pub. Date: Apr. 28, 2011

(65) Prior Publication Data

US 2012/0217272 A1 Aug. 30, 2012

(30) Foreign Application Priority Data

Oct. 21, 2009 (CH) ..... 1616/09

(51) Int. Cl.
*B22D 41/24* (2006.01)

(52) U.S. Cl.
CPC ..... *B22D 41/24* (2013.01)

(58) Field of Classification Search
CPC ..... B22D 41/24; B22D 41/40; B22D 41/34; B22D 41/38; B22D 41/26; B22D 41/14; B22D 41/22; B22D 41/56
USPC ..... 222/597, 600, 606, 607; 266/236
See application file for complete search history.

(56) References Cited

U.S. PATENT DOCUMENTS

| | | | | | |
|---|---|---|---|---|---|
| 5,139,238 | A | | 8/1992 | Buhr | |
| 5,173,199 | A | * | 12/1992 | Bruckner et al. | 222/600 |
| 5,174,908 | A | * | 12/1992 | King et al. | 222/600 |
| 5,693,249 | A | * | 12/1997 | Szadkowski | 222/590 |
| 5,698,129 | A | * | 12/1997 | Keller et al. | 222/600 |
| 5,836,485 | A | | 11/1998 | Plattner et al. | |
| 5,879,579 | A | * | 3/1999 | Yoshino et al. | 222/606 |
| 6,019,258 | A | | 2/2000 | Richard | |

FOREIGN PATENT DOCUMENTS

| | | | |
|---|---|---|---|
| DE | 40 12 093 | C1 | 2/1991 |
| EP | 0 468 363 | A1 | 1/1992 |
| EP | 0 869 856 | A1 | 12/1998 |
| EP | 0 819 488 | B1 | 2/2000 |
| WO | 2009127333 | A1 | 10/2009 |

* cited by examiner

*Primary Examiner* — Scott Kastler
*Assistant Examiner* — Michael Aboagye
(74) *Attorney, Agent, or Firm* — Brian Roffe

(57) ABSTRACT

A fireproof unit for a sliding closure at the spout of a container containing metal melt, including a fireproof adapter block that can be placed on the container spout, a fireproof bottom plate connected thereto, to which bottom plate a slidable fireproof sliding plate can be connected, wherein the sliding plate allows the sliding closure to be opened or closed. In addition to the first bottom plate connected to the adapter block, a second bottom plate adjoins the adapter block. The second bottom plate can be slid in under the adapter block to replace the first bottom plate. The adapter block has a length in the direction of the second bottom plate such that the adapter block is in sliding contact with the second bottom plate at the lower sliding surface of the adapter block.

20 Claims, 1 Drawing Sheet

FIREPROOF UNIT FOR A SLIDING CLOSURE AT THE SPOUT OF A CONTAINER FOR METAL MELT

FIELD OF THE INVENTION

The invention relates to a refractory unit for a sliding gate at the spout of a container containing metal melt, comprising a refractory adapter block that can be placed on the container spout, a refractory bottom plate connected thereto, to which bottom plate a slidable refractory sliding plate can be connected, wherein the sliding plate allows the sliding gate to be opened or closed, in addition to the first bottom plate connected to the adapter block, a second bottom plate adjoining the adapter block, which second bottom plate can be slid in under the adapter block to replace the first bottom plate.

BACKGROUND OF THE INVENTION

Sliding gates at the spout of containers for metal melt are known in a wide variety of configurations. A sliding gate which is used in particular for opening and closing a converter spout opening is disclosed, for example, in EP 0 819 488 B1. It comprises a housing frame in which are located a stationary refractory valve plate (a so-called bottom plate) and a refractory sliding plate held in a sliding unit and which can be displaced relative to said bottom plate. The sliding plate can be pressed tightly against a lower sliding surface of the bottom plate with its upper sliding surface. The housing frame is releaseably attached to a base plate secured to the container, it being possible to brace the bottom plate over its upper sliding surface with a refractory spout head part inserted into the base plate. During casting operation the refractory parts are subjected to strong wear and tear. It is therefore necessary to replace them relatively frequently. For this purpose the housing frame must be respectively detached from the base plate.

OBJECTS AND SUMMARY OF THE INVENTION

The present invention is based upon the object of providing a refractory unit for a sliding gate at the spout of a container for metal melt, in particular a converter, in which the exchangeability in particular of the refractory bottom plates of this unit can be implemented reliably and easily.

This object is achieved according to the invention by a refractory unit for a sliding gate at the spout of a container containing metal melt, comprising a refractory adapter block placed on the container spout, a first refractory bottom plate connected thereto and against which a slidable refractory sliding plate is pressed, a second bottom plate adjoining the adapter block which is slid in under the adapter block to replace the first bottom plate, wherein the adapter block has a length in the direction of the second bottom plate such that it is in sliding contact with its lower sliding surface with this second bottom plate, and by a sliding gate including a housing frame adapted to be attached to the spout, a slider unit comprising the sliding plate, a refractory unit as described above and a cassette contained in the housing frame and holding the first and second bottom plates next to one another, the cassette being displaceable in the housing frame such that the first bottom plate located in the operating position is replaced by the second bottom plate.

Further preferred configurations of the valve plate according to the invention form the subject matter of the dependent claims.

With the refractory unit according to the invention replacement of the bottom plates when the sliding gate is fitted can be implemented without any problem.

BRIEF DESCRIPTION OF THE DRAWINGS

In the following the invention is described in more detail by means of the drawings. These show as follows.

DETAILED DESCRIPTION OF THE INVENTION

Figure 1:
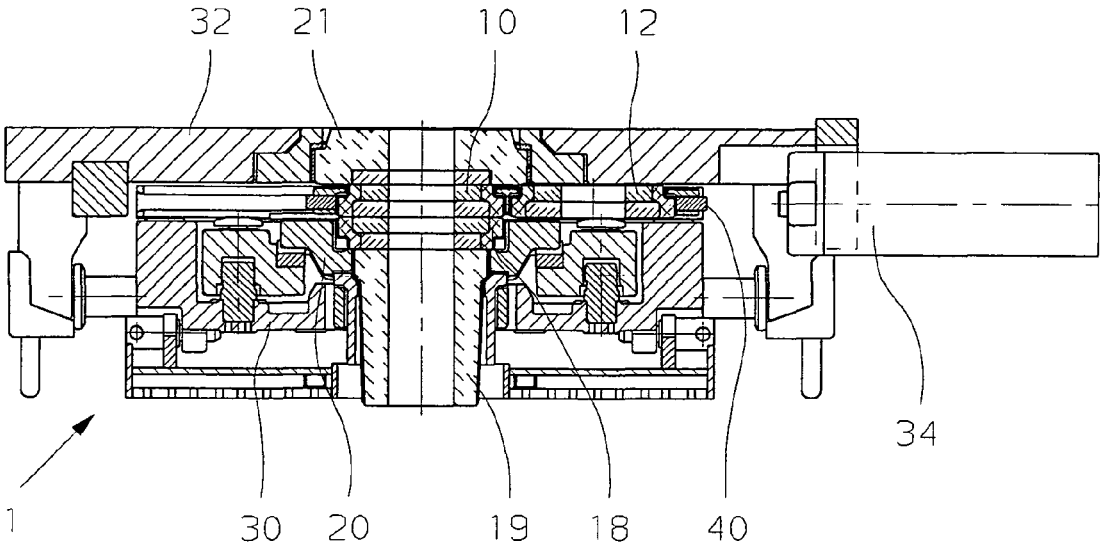
FIG. 1 is a cross section of a sliding gate with a cassette located in an initial position and containing two bottom plates.

A sliding gate 1 according to FIG. 1 is preferably disposed on the spout of a converter of which only a base plate 32 carrying the sliding gate 1 is visible, in which a refractory adapter block 21 is fitted. The sliding gate 1 has a housing frame 30 with a cassette 40 in which a refractory bottom plate 10 and a second bottom plate 12 that is also refractory are inserted. Furthermore, there is disposed in the housing frame 30 a slider unit 20 with a refractory sliding plate 18 and a refractory spout cover 19 connected to the latter.

For the opening and closing of the sliding gate 1 the slider unit 20 is moved perpendicularly to the image plane together with the sliding plate 18 and the spout cover 19 located beneath the latter, this not being illustrated in detail.

In the sliding gate 1, the one bottom plate 10 can be moved out of the operating position by displacing the cassette 40 by means of a drive 34 provided, for example, as a cylinder unit and be replaced by the second bottom plate 12 without having to dismantle the housing frame 30.

Figure 2:
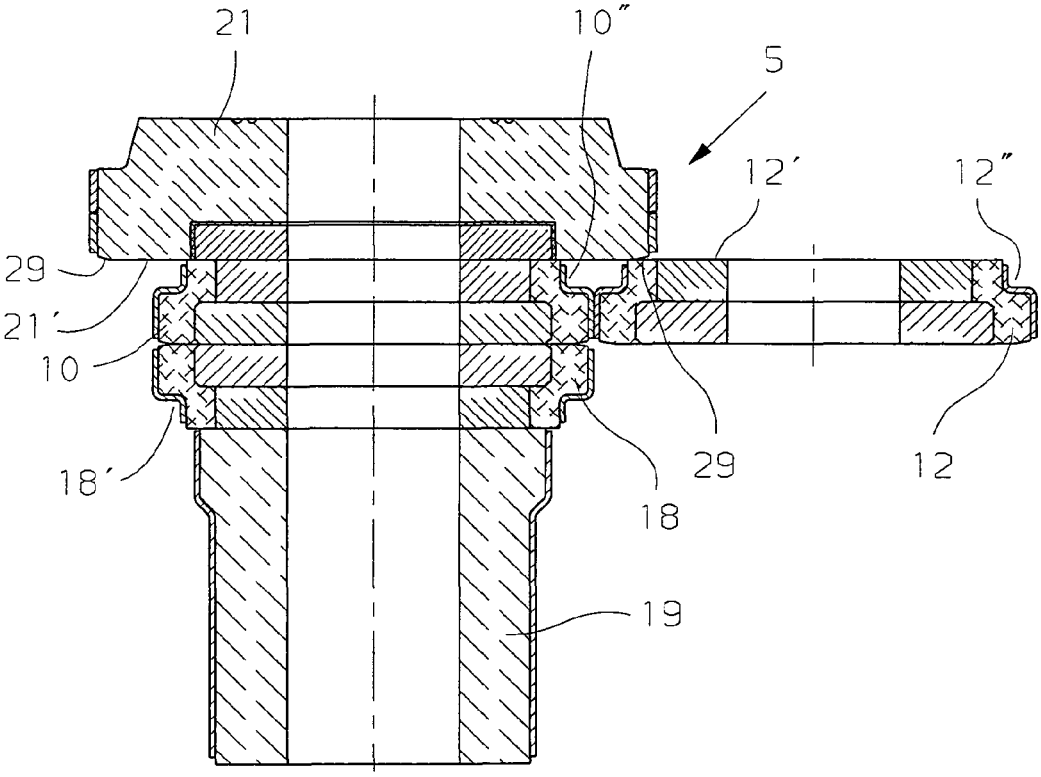
FIG. 2 is a cross section of the sliding gate according to FIG. 1, with the cassette in a final position.

FIG. 2 shows the refractory unit 5 for the sliding gate 1 which is provided with a refractory adapter block 21 that can be placed on the container spout. Connected to this is the refractory bottom plate 10 to which the displaceable refractory sliding plate 18 and the spout cover 19 can be connected. There is a second bottom plate 12 adjacent to the first bottom plate 10 connected to the adapter block 21. The two bottom plates 10, 12 are advantageously designed with identical external dimensions, the first bottom plate 10 being aligned with its opening concentric to that of the adapter block 21.

According to the invention the adapter block 21 has a length in the direction of the second bottom plate 12 such that it is in sliding contact with its lower sliding surface 21' with this second bottom plate 12. Advantageously the adapter block 21 is in sliding contact with this second bottom plate 12 at least over a length of a couple of millimeters.

The adapter block 21 has a round external form and correspondingly lies in the form of segments on the upper sliding surface 12' of the second bottom plate 12. It is provided on its lower sliding surface 21', at least in the region standing with this second bottom plate 12, with bevelling 29. Advantageously such bevelling 29 is also provided opposite if the bottom plate 10 is slid in from the other side.

The refractory parts of this refractory unit 5 respectively comprise at least one zircon insert or the like and a refractory mass surrounding the latter. In addition, there are also metal cassettes respectively forming the outer periphery. A gradation 10", 12", 18" provided all around is respectively assigned to the bottom or slider plate which enables almost play-free insertion of the latter into the housing frame 30 or into the slider unit 20.

The invention claimed is:

1. A refractory unit for a sliding gate at a spout of a container receivable of metal melt, the container including a base plate in which the spout is defined, the refractory unit comprising:

a refractory adapter block adapted to be placed on the container spout and having an opening, said adapter block having a lower surface, a first refractory bottom plate having an upper surface in contact with the lower surface of the adapter block, the first bottom plate having an opening aligning with the opening in the adapter block when the first bottom plate is in an operating position, the first bottom plate being movable relative to the adapter block while the upper surface of the first bottom plate is in contact with the lower surface of the adapter block, a slidable refractory sliding plate that is pressed against the first bottom plate when in the operating position, the sliding plate having an opening and being movable between a first position in which the opening of the sliding plate aligns with the openings in the first bottom plate when in the operating position and the adapter block to provide the sliding gate with an open condition and a second position in which the opening of the sliding plate does not align with the opening in the first bottom plate when in the operating position to provide the sliding gate with a closed condition, the sliding plate having an upper surface in contact with a lower surface of the first bottom plate when in the operating position, and a second refractory bottom plate adjoining the adapter block, the second bottom plate being movable from a non-operating position alongside the first bottom plate to the operating position under the adapter block to replace the first bottom plate, the adapter block having a length in the direction of the second bottom plate such that an upper surface of the second bottom plate is in contact with the lower surface of the adapter block while the second bottom plate is in the non-operating position and at the same time that the upper surface of the first bottom plate is in contact with the lower surface of the adapter block while the first bottom plate is in the operating position.

2. The refractory unit according to claim 1, the adapter block is in sliding contact with the second bottom plate at least over a length of a couple of millimeters.

3. The refractory unit according to claim 1, wherein the adapter block has a round external form and lies in the form of segments on the upper surface of the second bottom plate.

4. The refractory unit according to claim 1, wherein the adapter block has bevelling on its lower surface, at least in the region standing with the second bottom plate.

5. The refractory unit according to claim 1, wherein the first and the second bottom plates are designed with identical external dimensions, the first bottom plate being aligned with its opening concentric to the opening of the adapter block.

6. The refractory unit according to claim 1, wherein a gradation provided all around is assigned respectively to the bottom plates for insertion into a housing frame and which are arranged against the adapter block.

7. A sliding gate comprising:

a housing frame adapted to be attached to the spout, a slider unit comprising the sliding plate, and a refractory unit according to claim 1, the sliding gate further comprising a cassette contained in the housing frame and holding the first and second bottom plates next to one another, the cassette being displaceable in the housing frame such that the first bottom plate located in the operating position is replaced by the second bottom plate.

8. The sliding gate according to claim 7, further comprising a drive for displacing the cassette between an initial position and a final position.

9. The sliding gate according to claim 7, wherein the cassette has edging with a graduated profile in which the first bottom plate and the second bottom plate are inserted almost without any play.

10. The sliding gate according to claim 1, wherein the sliding plate is configured to be movable in a direction perpendicular to a direction of movement of the first and second bottom plates.

11. The sliding gate according to claim 1, wherein the length of the adapter block in the direction of the second bottom plate is perpendicular to a sliding direction of the sliding plate.

12. An arrangement, comprising:

a container receivable of molten metal, the container including a base plate in which a spout is defined; and a sliding gate comprising a refractory unit arranged in the spout, the refractory unit comprising:

a refractory adapter block placed in the spout and having an opening, said adapter block having a lower surface, a first refractory bottom plate having an upper surface in contact with the lower surface of the adapter block, the first bottom plate having an opening aligning with the opening in the adapter block when the first bottom plate is in an operating position, the first bottom plate being movable relative to the adapter block while the upper surface of the first bottom plate is in contact with the lower surface of the adapter block, a slidable refractory sliding plate that is pressed against the first bottom plate when in the operating position, the sliding plate having an opening and being movable between a first position in which the opening of the sliding plate aligns with the openings in the first bottom plate when in the operating position and the adapter block to provide the sliding gate with an open condition and a second position in which the opening of the sliding plate does not align with the opening in the first bottom plate when in the operating position to provide the sliding gate with a closed condition, the sliding plate having an upper surface in contact with a lower surface of the first bottom plate when in the operating position, a second refractory bottom plate adjoining the adapter block, the second bottom plate being movable from a non-operating position alongside the first bottom plate to the operating position under the adapter block to replace the first bottom plate, the adapter block having a length in the direction of the second bottom plate such that an upper surface of the second bottom plate is in contact with the lower surface of the adapter block while the second bottom plate is in the non-operating position and at the same time that the upper surface of the first bottom plate is in contact with the lower surface of the adapter block while the first bottom plate is in the operating position.

13. The arrangement of claim 10, wherein the adapter block is fitted in the base plate.

14. The arrangement of claim 10, wherein the adapter block is in sliding contact with the second bottom plate at least over a length of a couple of millimeters.

15. The arrangement of claim 10, wherein the adapter block has a round external form and lies in the form of segments on the upper surface of the second bottom plate.

16. The arrangement of claim 10, wherein the adapter block has beveling on its lower surface, at least in the region standing with the second bottom plate.

17. The arrangement of claim 10, wherein the first and the second bottom plates are designed with identical external dimensions, the first bottom plate being aligned with its opening concentric to the opening of the adapter block.

18. The arrangement of claim 10, further comprising:

a housing frame attached to the base plate, a slider unit comprising the sliding plate;

a cassette contained in the housing frame and holding the first and second bottom plates next to one another, the cassette being displaceable in the housing frame such that the first bottom plate located in the operating position is replaced by the second bottom plate.

19. The arrangement of claim 18, further comprising a drive for displacing the cassette between an initial position and a final position.

20. The arrangement of claim 18, wherein the cassette has edging with a graduated profile in which the first bottom plate and the second bottom plate are inserted almost without any play.

* * * * *